US006527526B2

(12) United States Patent
Chang et al.

(10) Patent No.: US 6,527,526 B2
(45) Date of Patent: Mar. 4, 2003

(54) SCROLL COMPRESSOR HAVING WRAPS OF VARYING THICKNESS

(75) Inventors: Young Il Chang, Seoul (KR); Yang Hee Cho, Seoul (KR)

(73) Assignee: LG Electronics, Inc., Seoul (KR)

( * ) Notice: Subject to any disclaimer, the term of this patent is extended or adjusted under 35 U.S.C. 154(b) by 0 days.

(21) Appl. No.: 09/919,857

(22) Filed: Aug. 2, 2001

(65) Prior Publication Data

US 2002/0071780 A1 Jun. 13, 2002

(30) Foreign Application Priority Data

Dec. 7, 2000 (KR) ..... 2000-74285
Dec. 8, 2000 (KR) ..... 2000-74511

(51) Int. Cl.[7] ..... F04C 18/04
(52) U.S. Cl. ..... 418/55.2
(58) Field of Search ..... 418/55.2

(56) References Cited

U.S. PATENT DOCUMENTS 4,490,099 A * 12/1984 Terauchi et al. ..... 418/55.2

FOREIGN PATENT DOCUMENTS

| | | | | |
|---|---|---|---|---|
| DE | 1628418 | * | 7/1977 | ..... 418/55.2 |
| JP | 58-13184 | * | 1/1983 | ..... 418/55.2 |
| JP | 2-19678 | * | 1/1990 | ..... 418/55.2 |
| JP | 3-11103 | * | 1/1991 | ..... 418/55.2 |
| JP | 4-94484 | * | 3/1992 | ..... 418/55.2 |

* cited by examiner

*Primary Examiner*—John J. Vrablik
(74) *Attorney, Agent, or Firm*—Birch, Stewart, Kolasch & Birch, LLP

(57) ABSTRACT

Scroll compressor including wraps of involute curves on opposite surfaces of an orbiting scroll and a fixed scroll engaged to each other, to form a compression chamber as the orbiting scroll orbits with respect to the fixed scroll, wherein each of the wraps on opposite surfaces of the orbiting scroll and the fixed scroll is formed from two or more involute curves each having a base circle and a point of starting different from each other, thereby permitting to secure a larger compression space for a same sized scroll compressor while reliability of the scroll compressor is not made poor, to reduce centrifugal force and noise occurring the orbiting scroll, and improving stability of the orbiting scroll.

5 Claims, 14 Drawing Sheets

SCROLL COMPRESSOR HAVING WRAPS OF VARYING THICKNESS

BACKGROUND OF THE INVENTION

1. Field of the Invention

The present invention relates to scroll compressors, and more particularly, to a wrap structure of each scroll in the scroll compressor for compressing refrigerant as an orbiting scroll orbits a fixed scroll.

2. Background of the Related Art

In general, the scroll compressors are mostly used in room air conditioners or car air conditioners as the scroll compressors have low noise, and small sized and light weighted, in which one pair of opposite scrolls form a compression chamber, in which the refrigerant is compressed. FIG. 1 illustrates a section of a related art scroll compressor, referring to which the related art scroll compressor will be explained.

Referring to FIG. 1, there is an enclosed shell of a body 1 having an inlet tube 11 and an outlet tube 15 connected thereto for drawing and discharging the refrigerant, respectively. There is a fixed scroll 8 in an upper part of the body 1 having an outlet 12 at a central part 12 thereof and a wrap 8*a* of an involute curve projected downward from a bottom thereof. Also, there is an orbiting scroll 7 under the fixed scroll 8 orbitably coupled with the fixed scroll 8 in correspondence thereto having a wrap 7*a* of an involute curve projected upward. Side surfaces of the wraps 8*a* and 7*a* on the fixed, and orbiting scrolls 8 and 7 are made to be brought into contact as well as fore ends of the wraps 8*a* and 7*a* and scroll dish plates (disks the wraps are formed thereon), to form a compression chamber (a space which encloses refrigerant therein and is involved in gradual reduction for implementing compression).

The orbiting scroll 7 has a crank shaft 6 fixed to a bottom thereof for orbiting the orbiting scroll 7 as the crank shaft 6 transmits a rotating force from a motor part 5, provided in a lower part of the body 1, to the orbiting scroll 7 via an Oldham ring 9 that prevents rotation of the orbiting scroll 7, to reduce a volume of the compression chamber gradually to compress the refrigerant trapped between the two scrolls 7 and 8 and discharge through the outlet tube 15.

FIGS. 2A~2D illustrate the steps of a process for compressing refrigerant in a related art scroll compressor, referring to which the operation of the related art scroll compressor will be explained in detail.

Upon application of power to the motor part 5, the crank shaft 6 rotates to rotate the orbiting scroll 7 fixed on a top thereof. In this instance, the orbiting scroll 7 is made to orbit spaced from a center of the crank shaft 6 by a preset orbiting radius in a state rotation is prevented by the Oldham ring 9. As shown in FIG. 2B, low temperature and low pressure refrigerant 20 drawn into the body 1 through the inlet tube 11 after being heat exchanged at an evaporator during the foregoing process is the compression chamber through refrigerant inlets 21 and 22 formed by the wraps 8*a* and 7*a* on the fixed scroll 8 and the orbiting scroll 7, respectively.

Then, as shown in FIGS. 2C and 2D, as the orbiting scroll 7 keeps to orbit, the refrigerant is involved in gradual decrease of a volume thereof and flows toward a central portion of the compression chamber, i.e., to a location where the outlet 12 of the fixed scroll 8 is formed. It can be known that, as explained, the refrigerant is compressed to high temperature and pressure as the refrigerant is involved in gradual decrease of volume during the refrigerant flows toward the central portion of the compression chamber.

At the end, as shown in FIG. 2D, the refrigerant compressed thus is discharged through the outlet 12 passed through the fixed scroll 8, and, therefrom, to a condenser through the outlet tube 15, when new refrigerant to be compressed is drawn through the refrigerant inlets 21 and 22 of the compression chamber formed as the scrolls 7 and 8 are engaged.

The foregoing related art scroll compressor is required to compress the refrigerant gradually as the refrigerant goes toward the central portion of the compression chamber, for which it is very important that the wraps 7*a* and 8*a* of the orbiting scroll 7 and the fixed scroll 8 are required to be designed to come into a close contact at appropriate positions.

FIGS. 3A~3C illustrate the steps of a process for forming an orbiting scroll wrap of a related art scroll compressor, referring to which structures of the orbiting scroll wrap 7*a* and a fixed scroll wrap 8*a* of the related art scroll compressor will be explained.

Referring to FIG. 3A, a base circle 30 with a radius 'a' is drawn on a center on an X-, and Y-axes. Then, an involute curve is drawn, taking one point on a circumference of the base circle 30 at a starting angle 'a' from the X-axis as a starting point, i.e., an inner involute curve is drawn. One point on the inner involute curve 31 for the base circle 30 may be expressed with a parameter 'θ' as follows.

$$X_i = a \times \{\cos(\theta_i - \alpha) + \theta_i \times \sin(\theta_i - \alpha)\},$$

and $$Y_i = a \times \{\sin(\theta_i - \alpha) - \theta_i \times \cos(\theta_i - \alpha)\}$$

Then, as shown in FIG. 3B, in order to form a thickness of the wrap 7*a* of the orbiting scroll 7, another involute curve started from a point at '−α' angle to the X-axis on the circumference of the base circle 30, i.e., an outer involute curve 32, is drawn. One point on the outer involute curve 32 for the base circle 30 may be expressed with a parameter 'θ' as follows.

$$X_o = a \times \{cos(\theta_o + \alpha) + \theta_o \times \sin(\theta_o + \alpha)\},$$

and $$Y_i = a \times \{sin(\theta_o + \alpha) - \theta_o \times \cos(\theta_o + \alpha)\}$$

A distance of the inner involute curve 31 and the outer involute curve form a thickness 't' for forming the wrap. Thus, as shown in FIG. 3C, upon completion of formation of involute curves, the orbiting scroll 7*a* can be formed by using the involute curves.

FIGS. 4A~4C illustrate the steps of a process for forming a fixed scroll wrap of a related art scroll compressor, the fixed scroll wrap 8*a* is formed in a form having a 180° phase difference from the orbiting scroll wrap 7*a*. That is, a base circle 40 with a radius 'a' is drawn in a method identical to the base circle 30 drawn for the orbiting scroll wrap 7*a*, inner and outer involute curves 41 and 42 are drawn starting from points on the circumference of the base circle 40, and the fixed scroll wrap 8*a* is formed based on the involute curves 41 and 42 of the scroll compressor, of which detailed explanation will be omitted.

For making appropriate points of the wraps 7*a* and 8*a* of the orbiting scroll 7 and the fixed scroll 8 being brought into contact, orbiting radiuses of the involute curves are required to have a relation of (P−2t)/2, where P=2πa, i.e., a pitch of the wraps 7*a* and 8*a* on the scrolls, and 't'=2aα, i.e., the thickness of the wrap. Accordingly, the compression chamber is formed as the orbiting scroll 7 is made to orbit along an orbiting radius by the motor 5, and the refrigerant drawn into the compression chamber is compressed.

However, the foregoing scroll wrap structures have the following problems in light of the present trend in which the scroll compressor is made smaller while capacity and efficiency are enhanced.

That is, in order to increase a capacity of the related art scroll compressor, there is no way, but to increase a height of the wrap on the scroll, or to increase an overall size of the scroll compressor, which, not only is against the recent trend of making the scroll compressor smaller, but also makes a reliability of the scroll compressor poor, if the heights of the wraps on the scrolls are increased, that makes points of action of a pressure occurred as the refrigerant is compressed higher as much as the increased height of the wrap.

The increased centrifugal force in proportion to an increased mass of the orbiting scroll 7 causes noise heavier when the orbiting scroll 7 and the fixed scroll 8 are in contact, and a light weighted orbiting scroll is essential for extending application of the scroll compressor to a high compression range.

SUMMARY OF THE INVENTION

Accordingly, the present invention is directed to a scroll compressor that substantially obviates one or more of the problems due to limitations and disadvantages of the related art.

An object of the present invention is to provide a scroll compressor, which can secure a greater compression space for the same size of scroll compressor while reliability of the scroll compressor is not made poor.

Another object of the present invention is to provide a scroll compressor, which can reduce centrifugal force and noise occurring at the orbiting scroll, and enhance stability of the orbiting scroll.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the scroll compressor includes wraps of involute curves on opposite surfaces of an orbiting scroll and a fixed scroll engaged to each other, to form a compression chamber as the orbiting scroll orbits with respect to the fixed scroll, wherein each of the wraps on opposite surfaces of the orbiting scroll and the fixed scroll is formed from two or more involute curves each having a base circle and a point of starting different from each other.

The wraps on opposite surfaces of the orbiting scroll and the fixed scroll includes a first involute curve and a second involute curve of base circles and starting points different from each other employed alternately. The second involute curve preferably has the base circle radius and an angle to an X-axis of the starting point smaller than the first involute curve.

The first involute curve and the second involute curve are used alternately at 180° intervals of the involute angles of respective involute curves. The first and second involute curves preferably alternate at 90° of involute angle from an outer end of the orbiting scroll wrap or the fixed scroll wrap.

The orbiting scroll wrap employs the second involute curve from 450° of involute angle and over, and the fixed scroll wrap employs the second involute curve from 630° of involute angle and over.

In another aspect of the present invention, there is provided a scroll compressor including wraps of involute curves on opposite surfaces of an orbiting scroll and a fixed scroll engaged to each other, to form a compression chamber as the orbiting scroll orbits with respect to the fixed scroll, wherein the wraps of the orbiting scroll and the fixed scroll have thickness different from each other.

The wrap of the orbiting scroll has a thickness relatively thinner than the wrap of the fixed scroll.

The wraps of involute curves on the orbiting scroll and the fixed scroll have the same base circle radiuses 'a', and different angles of starting points of the wraps of $\alpha 1$ and ($\alpha 2$ to an X-axis, respectively. The angles of starting points $\alpha 1$ and ($\alpha 2$ have a relation of $0.5\alpha 1 \leqq \alpha 2 < \alpha 1$.

The wrap of the fixed scroll has a thickness formed relatively thinner than a thickness of the wrap of the orbiting scroll.

The wraps of involute curves on the orbiting scroll and the fixed scroll have the same base circle radiuses and angles of starting points of $\beta 1$ and $\beta 2$ different from each other. The angles of starting points $\beta 1$ and $\beta 2$ of wraps of the orbiting scroll and the fixed scroll respectively have a relation of $0.5\beta 1 \leqq \beta 2 < \beta 1$.

Thus, the scroll compressor of the present invention permits to secure a larger compression space for a same sized scroll compressor while reliability of the scroll compressor is not made poor, to reduce centrifugal force and noise occurring at the orbiting scroll, and improve stability of the orbiting scroll.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings.

First Embodiment

Figure 5A:
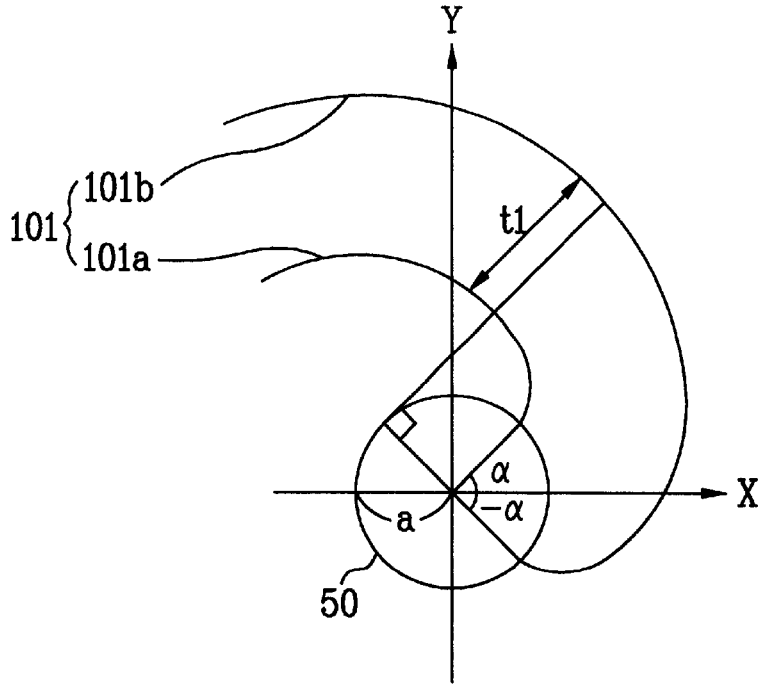
FIGS. 5A and 5B illustrate the steps of a process for forming a first and a second involute curves employed in an orbiting scroll wrap of a scroll compressor in accordance with a first preferred embodiment of the present invention.
Figure 5B:
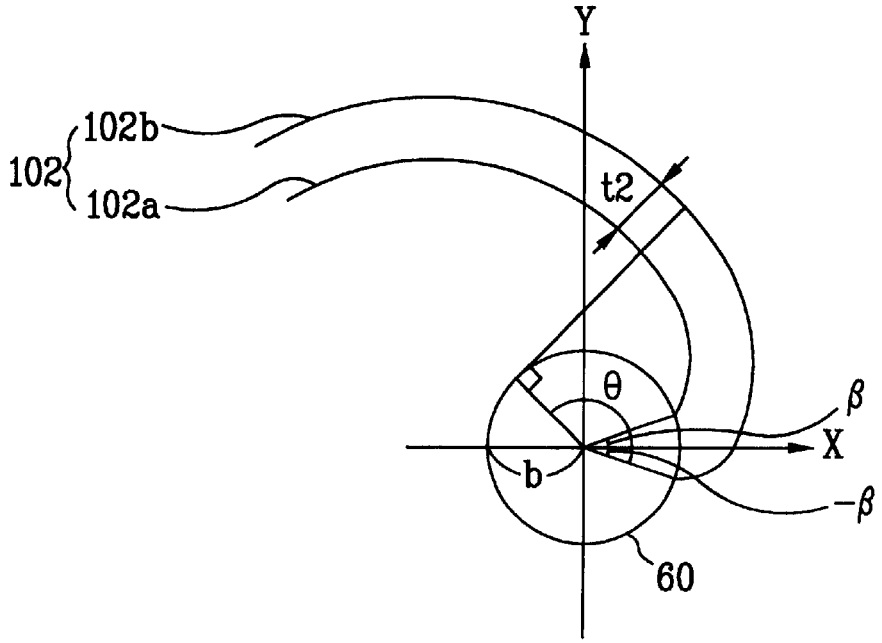

FIGS. 5A and 5B illustrate the steps of a process for forming a first and a second involute curves employed in an orbiting scroll wrap of a scroll compressor in accordance with a first preferred embodiment of the present invention, referring to which the steps of process for forming the first and second involute curves 101 and 102 will be explained.

In order to form an orbiting scroll wrap 100 (see FIG. 7), two involute curves, i.e., a first involute curve 101 and a second involute curve 102 are required.

As shown in FIG. 5A, for forming the first involute curve 101, an imaginary base circle 50 is formed with a radius 'a' centered on an X-axis, and a Y-axis. Then, an inner involute curve 101 a is drawn starting from a point on a circumference of the base circle 50 at angle '$\alpha$' from the X-axis. As shown in FIG. 5A, for forming a thickness 't1' of the orbiting scroll wrap 100 of the first involute curve 101, an outer involute curve 101*b* is formed starting from one point on a circumference of the base circle 50 at an angle '$-\alpha$' to the X-axis. Thus, a first involute curve 101 with a thickness 't1' is formed by using the inner involute curve 101*a* and the outer involute curve 101*b*.

As shown in FIG. 5B, for forming the second involute curve 102, an imaginary base circle 60 is formed with a radius 'b' centered on an X-axis, and a Y-axis. Then, an inner involute curve 102*a* is drawn starting from a point on a circumference of the base circle 60 at an angle '$\beta$' from the X-axis. As shown in FIG. 5B, for forming a thickness 't2' of the orbiting scroll wrap 100 of the second involute curve 102, an outer involute curve 102*b* is formed starting from one point on a circumference of the base circle 60 at an angle '$-\beta$' to the X-axis. Thus, a second involute curve 102 with a thickness 't2' is formed by using the inner involute curve 102*a* and the outer involute curve 102*b*.

Figure 6A:
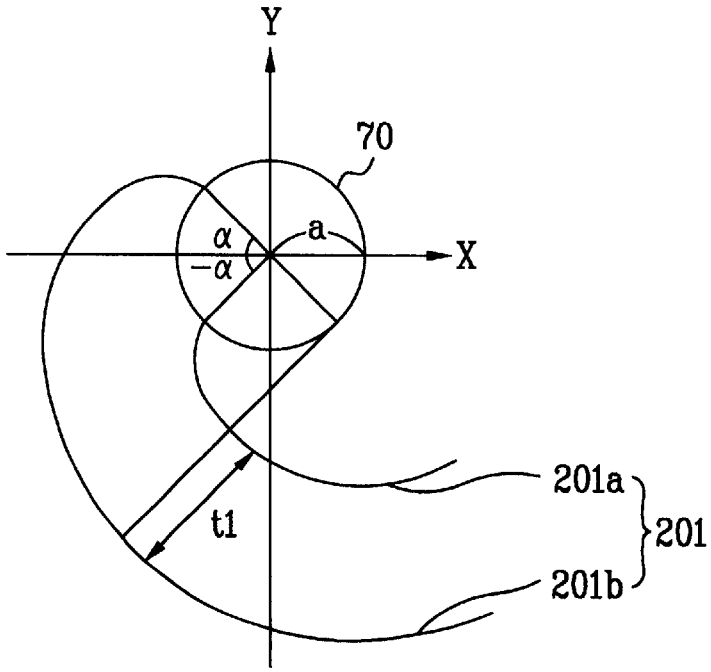
FIGS. 6A and 6B illustrate the steps of a process for forming a first and a second involute curves employed in a fixed scroll wrap of a scroll compressor in accordance with a first preferred embodiment of the present invention.
Figure 6B:
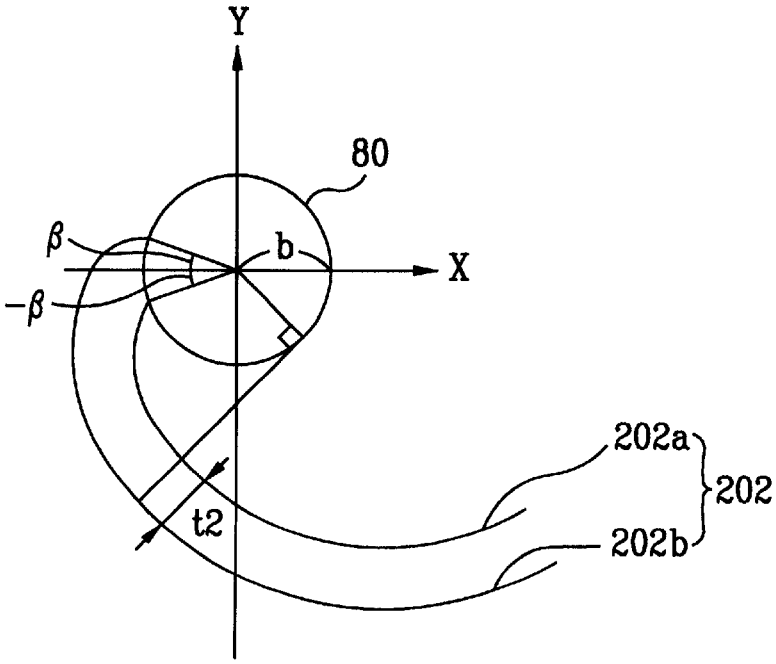

FIGS. 6A and 6B illustrate the steps of a process for forming a first and a second involute curves employed in a fixed scroll wrap of a scroll compressor in accordance with a first preferred embodiment of the present invention, referring to which the process for forming the first and second involute curves 201 and 202 will be explained.

In order to form the fixed scroll wrap 200 (see FIG. 7), it is required to draw two involute curves, a first involute curve 201 and a second involute curve 202, having a 180° phase difference from the orbiting scroll wrap 100.

As shown in FIG. 6A, for forming the first involute curve 201, an imaginary base circle 70 is formed with a radius 'a', and an inner involute curve 201*a* and an outer involute curve 201*b* are formed starting from points on a circumference of the base circle 70 at angles '$\alpha$' and '$-\alpha$' from an X-axis, respectively. Then, a first involute curve 201 having a thickness 't1' is formed by using the inner involute curve 201*a* and the outer involute curve 201*b*.

Then, as shown in FIG. 6B, an imaginary base circle 80 is formed with a radius 'b', and an inner involute curve 202*a* and an outer involute curve 202*b* are formed starting from points on a circumference of the base circle 80 at angles '$\beta$' and '$-\beta$' from an X-axis, respectively. Then, a second involute curve 202 having a thickness 't2' is formed by using the inner involute curve 202*a* and the outer involute curve 202*b*.

Figure 7:
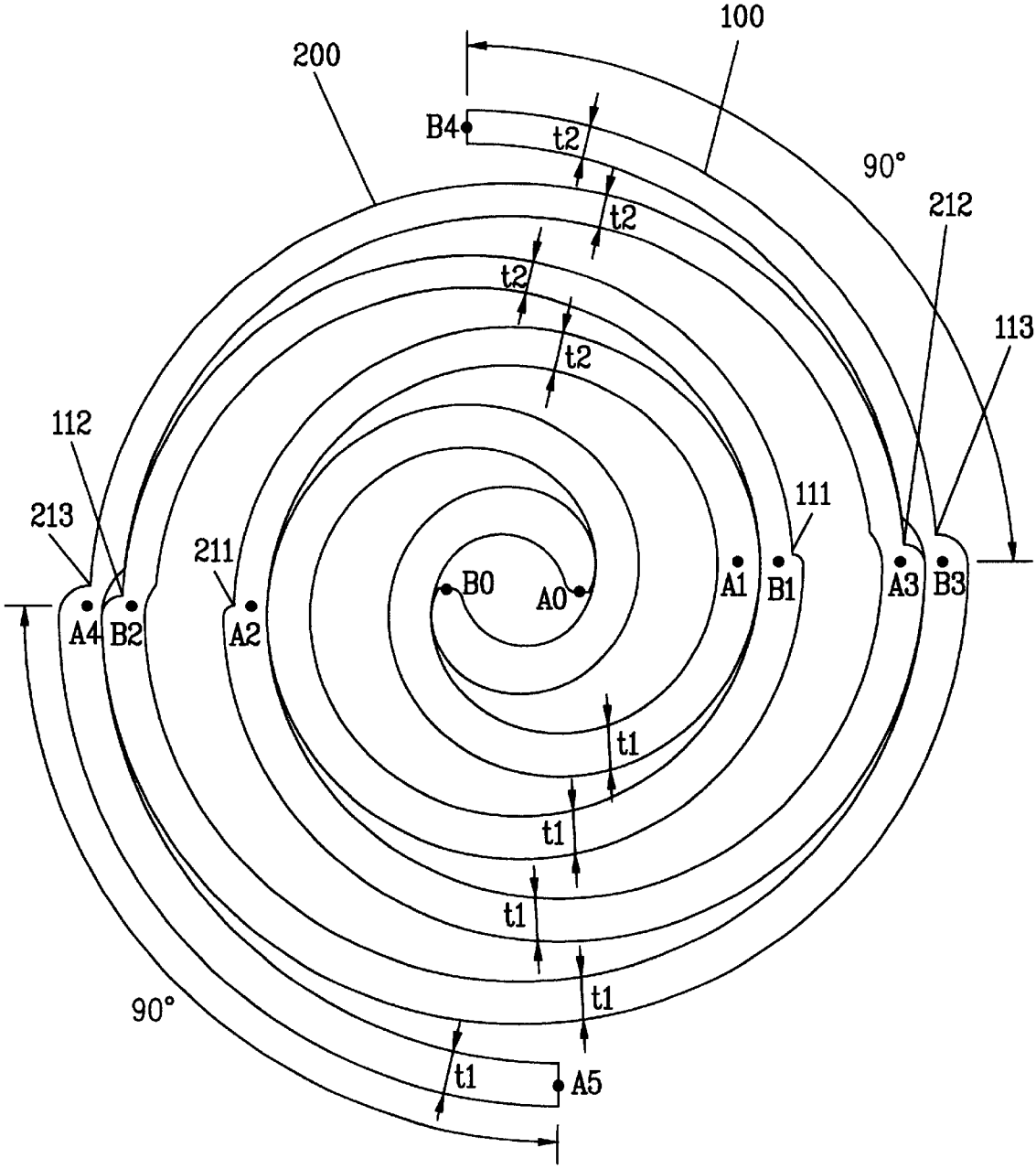
FIG. 7 illustrates a coupled state of an orbiting scroll wrap and a fixed scroll wrap formed in accordance with a first preferred embodiment of the present invention.

FIG. 7 illustrates a coupled state of an orbiting scroll wrap and a fixed scroll wrap formed in accordance with a first preferred embodiment of the present invention, referring to which structures of the orbiting scroll wrap 100 and the fixed scroll wrap 200 in accordance with a first preferred embodiment of the present invention will be explained.

As shown, because the orbiting scroll wrap 100 and the fixed scroll wrap 200 are formed to have the same orbit radiuses, surfaces of the wraps are brought into contact, to form a plurality of compression chambers. However, as explained, since the orbiting scroll wrap 100 and the fixed scroll wrap 200 are formed by employing two involute curves having different angles '$\alpha$' and '$\beta$' of starting points and radiuses of base circle diameters 'a' and 'b' alternately, the wraps 100 and 200 have forms with different thickness 't1' and 't2' alternated at fixed intervals, which will be explained in detail.

With regard to the structure of the fixed scroll wrap 200, a part of the wrap 200 from a starting point A0 at a central part of the wrap 200 to a point A1 at 450° of involute angle is formed according to a first involute curve 201 (see FIG. 6A), and a part of the wrap 200 from the point A1 to a point A2 at 180° of involute angle is formed according to a second involute curve 202 (see FIG. 6B).

Then a part of the wrap 200 from the point A2 to a point A3 at 180° of involute angle is formed according to the first involute curve 201 again, a part of the wrap 200 from the point A3 to a point A4 at 180° of involute angle is formed according to the second involute curve 202, and a part of the wrap 200 from the point A4 to a point A5 at 90° of involute angle is formed according to the first involute curve 201, again.

Figure 1:
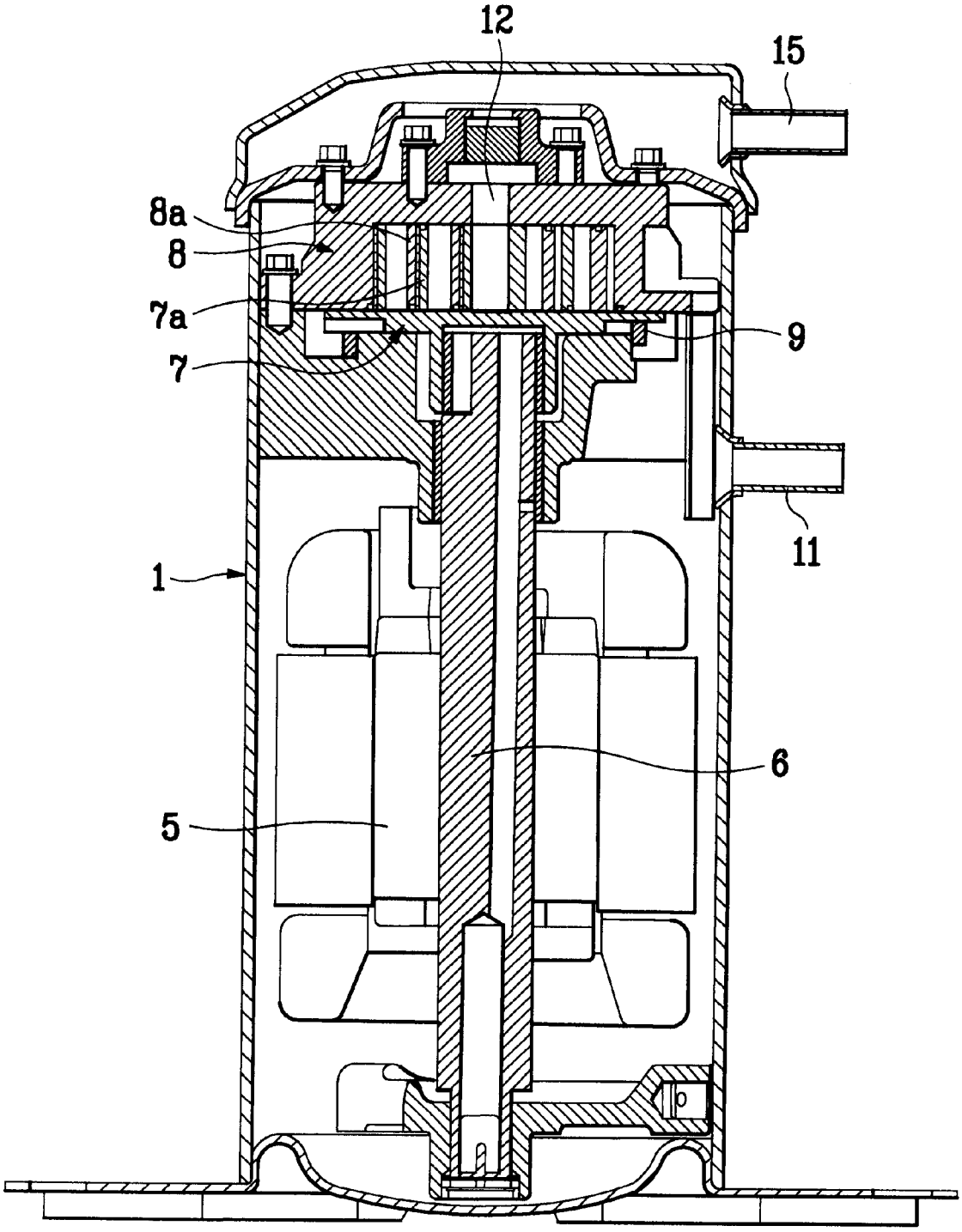
FIG.1 Related Art
FIG. 1 illustrates a section of a related art scroll compressor.
Figure 2A:
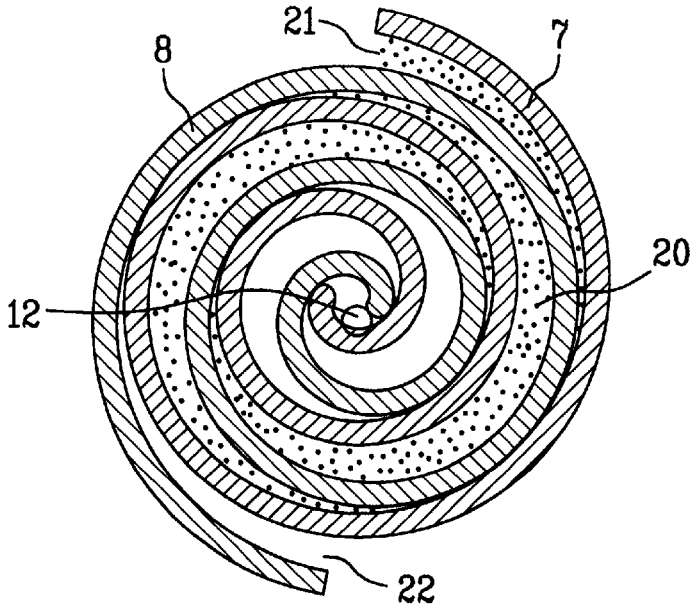
FIG. 2A Related Art
FIGS. 2A~2D illustrate the steps of a process for compressing refrigerant in a related art scroll compressor.
Figure 2B:
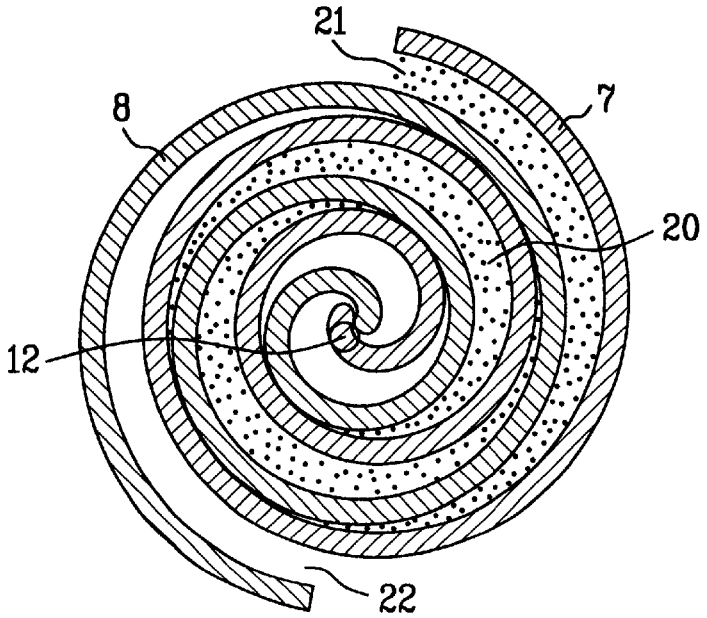
FIG. 2B Related Art
Figure 2C:
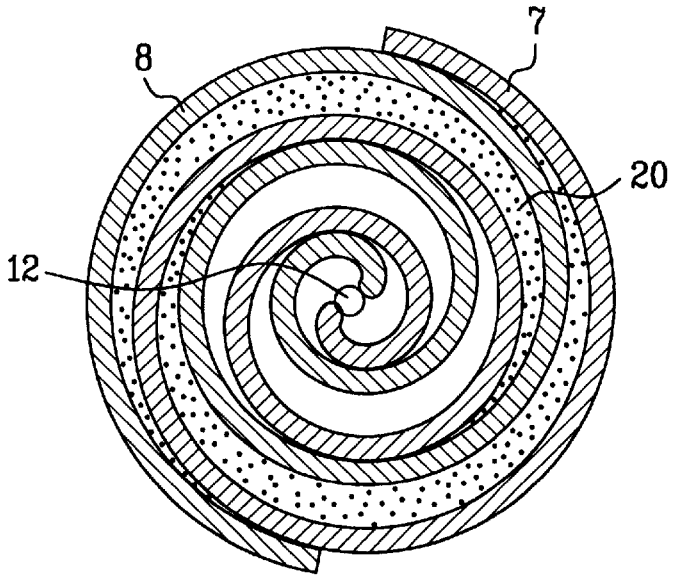
FIG.2C Related Art
Figure 2D:
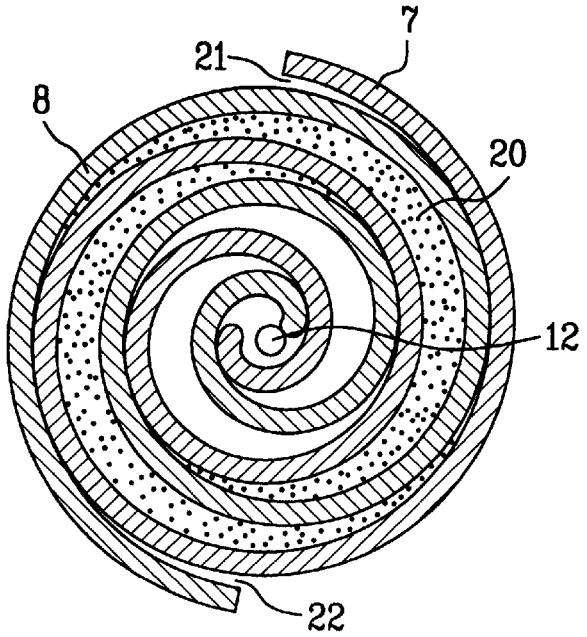
FIG.2D Related Art
Figure 3A:
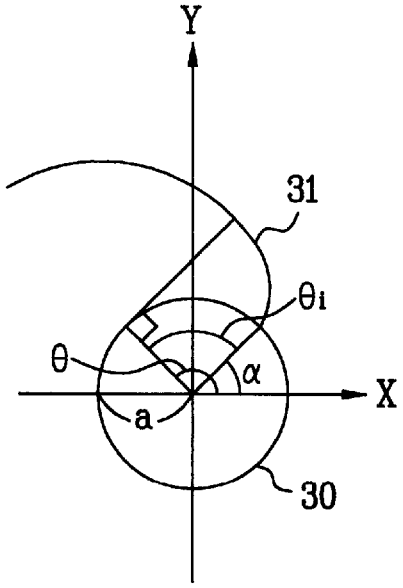
FIG.3A Related Art
FIGS. 3A~3C illustrate the steps of a process for forming an orbiting scroll wrap of a related art scroll compressor.
Figure 3B:
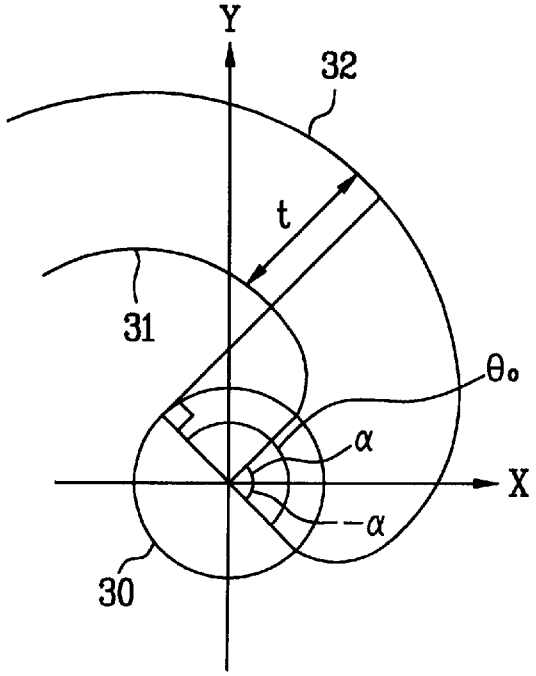
FIG.3B Related Art
Figure 3C:
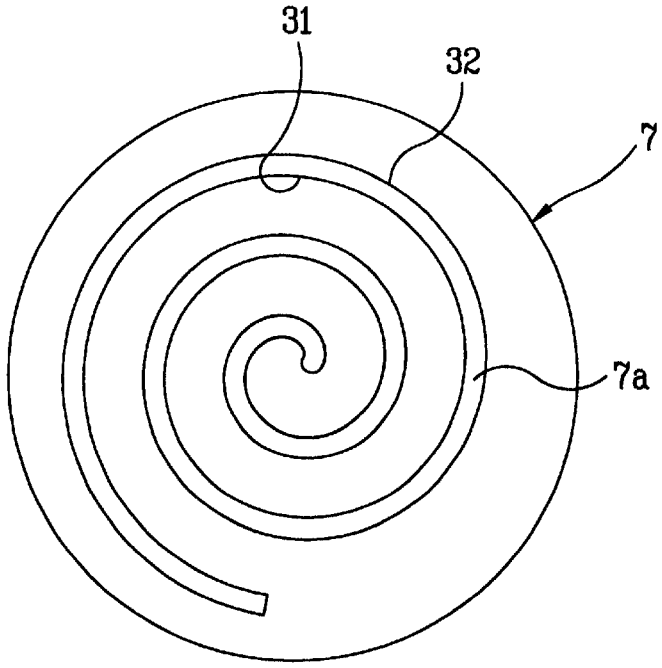
FIG. 3C Related Art
Figure 4A:
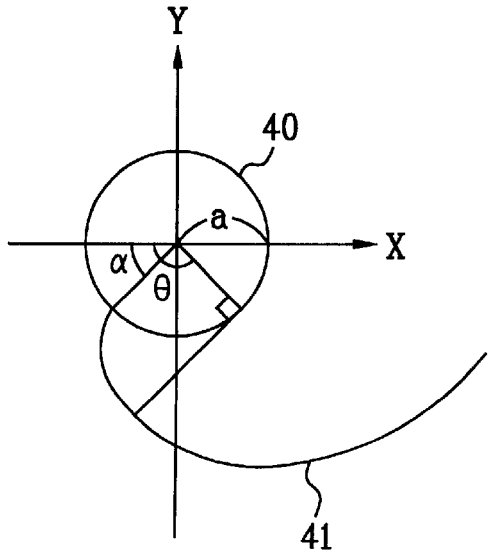
FIG. 4A Related Art
FIGS. 4A~4C illustrate the steps of a process for forming a fixed scroll wrap of a related art scroll compressor.
Figure 4B:
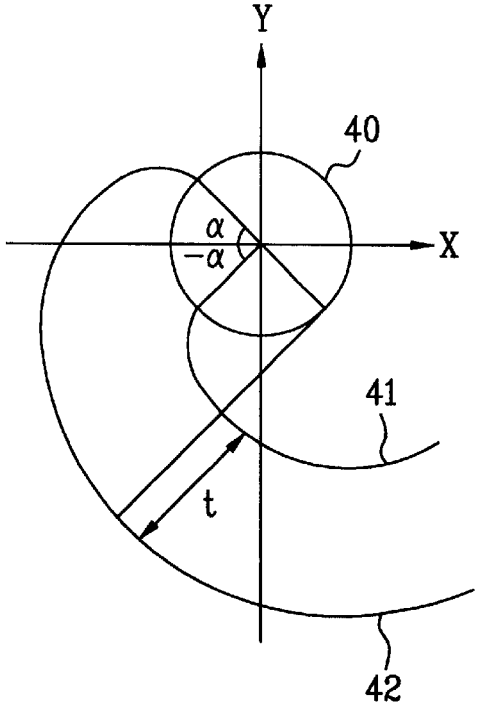
FIG. 4B Related Art
Figure 4C:
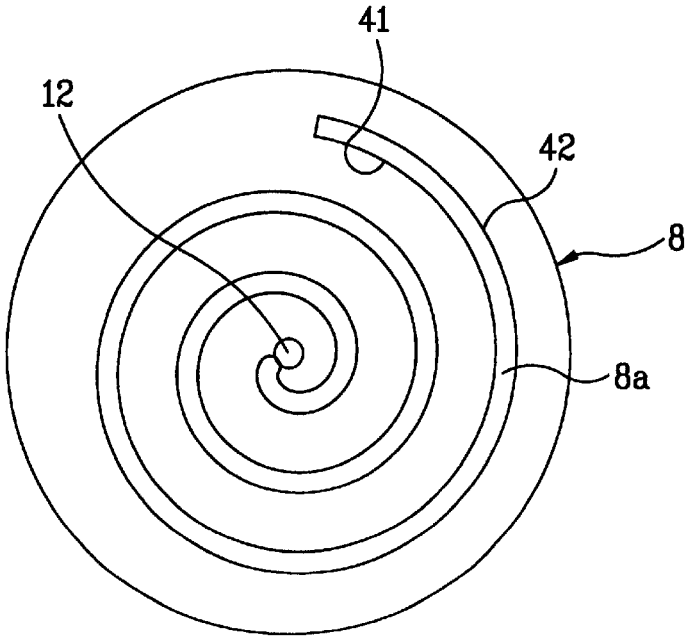
FIG. 4C Related Art

Of the parts of the fixed scroll wrap 200, parts formed according to the first involute curve 201 have the thickness of 't1' (the same with a wrap thickness 't' in the related art fixed scroll wrap 8*a*), and parts formed according to the second involute curve 202 have a thickness 't2' relatively thinner than the 't1'. Accordingly, the parts A1-A2, and A3-A4 have a wrap thickness thinner by t1–t2 than the thickness of the parts A0-A1, A2-A3, and A4-A5. That is, if it is assumed that the thickness 't' (see FIGS. 4B and 4C) of the related art fixed scroll wrap 8*a* is the same with the thickness 't1' of the fixed scroll wrap 200, the scroll compressor of the present invention is made to have a volume of the compression chamber increased by an amount of thickness reduction from 't1' to 't2' of the fixed scroll wrap 200. In this instance, since the part A0-A1 of the wrap 200 has a relatively high pressure occurred therein, it is preferable that the part A0-A1 of the wrap 200 is formed to have a thickness the same with the related art 't1' for preventing the central part of the wrap 200 suffering from damage.

Opposite to this, since parts from A1–A5 of the wrap 200 have absolute pressures and pressure differences between chambers comparatively lower than the central part of the wrap 200, strength of the wrap matters not so much, permitting to form the wrap thinner than the thickness of the related art wrap 8*a*.

Since the fixed scroll wrap 200 has different involute curves employed at each of the parts A1–A5, the wrap 200 has different thickness and radius of curvatures. Accordingly, steps 211, 212, and 213 are formed at the points A2–A4 for connecting parts of the wrap 200 having different thickness and radius of curvatures. The steps 211, 212, and 213 are arcs so that different surfaces of the orbiting scroll wrap 100 and the fixed scroll wrap 200 can maintain close contact states.

A structure of the orbiting scroll wrap 100 will be explained.

A part of the wrap 100 from a starting point B0 at a central part of the wrap 100 to a point B1 at 630° of involute angle is formed according to a first involute curve 101 (see FIG. 5A), and a part of the wrap 100 from the point B1 to a point B2 at 180° of involute angle is formed according to a second involute curve 102 (see FIG. 5B). A part of the wrap 100 from the point B2 to a point B3 at 180° of involute angle is formed according to the first involute curve 102 again, and a part of the wrap 100 from the point B3 to a point B4 at 90° of involute angle is formed according to a second involute curve 102.

Of the parts of the orbiting scroll wrap 100, parts formed according to the first involute curve 101 have the thickness of 't1' (the same with a wrap thickness 't' in the related art orbiting scroll wrap 7*a*), and parts formed according to the second involute curve 102 have a thickness 't2' relatively thinner than the 't1'. That is, the parts B1-B2, and B3-B4 have a wrap thickness t2 relatively thinner than the thickness of the parts B0-B1, and B2-B3. Accordingly, the wrap thickness in parts of B1-B2, and B3-B4 is made thinner by t1–t2 in comparison to the parts B0-B1 and B2-B3.

The scroll compressor of the present invention is made to have a volume of the compression chamber increased by an amount of thickness reduction from 't1' to 't2' of the orbiting scroll wrap 100. Moreover, mass of the orbiting scroll can be reduced as much as the reduction of volume of the orbiting scroll wrap 100.

In this instance, since the part B0-B1 of the wrap 100 has a relatively high pressure occurred therein, it is preferable that the central part of the wrap 100 is formed to have a thickness the same with the related art 't1'. Opposite to this, parts from B1-B2 and B3-B4 of the wrap 100 may be formed thinner than the thickness of the central part of the wrap 100.

Alike the fixed scroll wrap 200, since the orbiting scroll wrap 100 also has different involute curves employed at each of the parts B1–B4, the wrap 100 has different thickness and radius of curvatures. Accordingly, steps 111, 112, and 113 are formed at the points B2–B4 for connecting parts of the wrap having different thickness and radius of curvatures. Positions of the steps 111, 112, and 113 of the orbiting scroll wrap 100 and the steps 211, 212, and 213 of the fixed scroll wrap 200 are at 90° of an involute angle from an outer end of the orbiting scroll wrap 100 or the fixed scroll wrap 200. By doing so, an outer diameter of the orbiting scroll or the fixed scroll can be reduced.

Figure 8A:
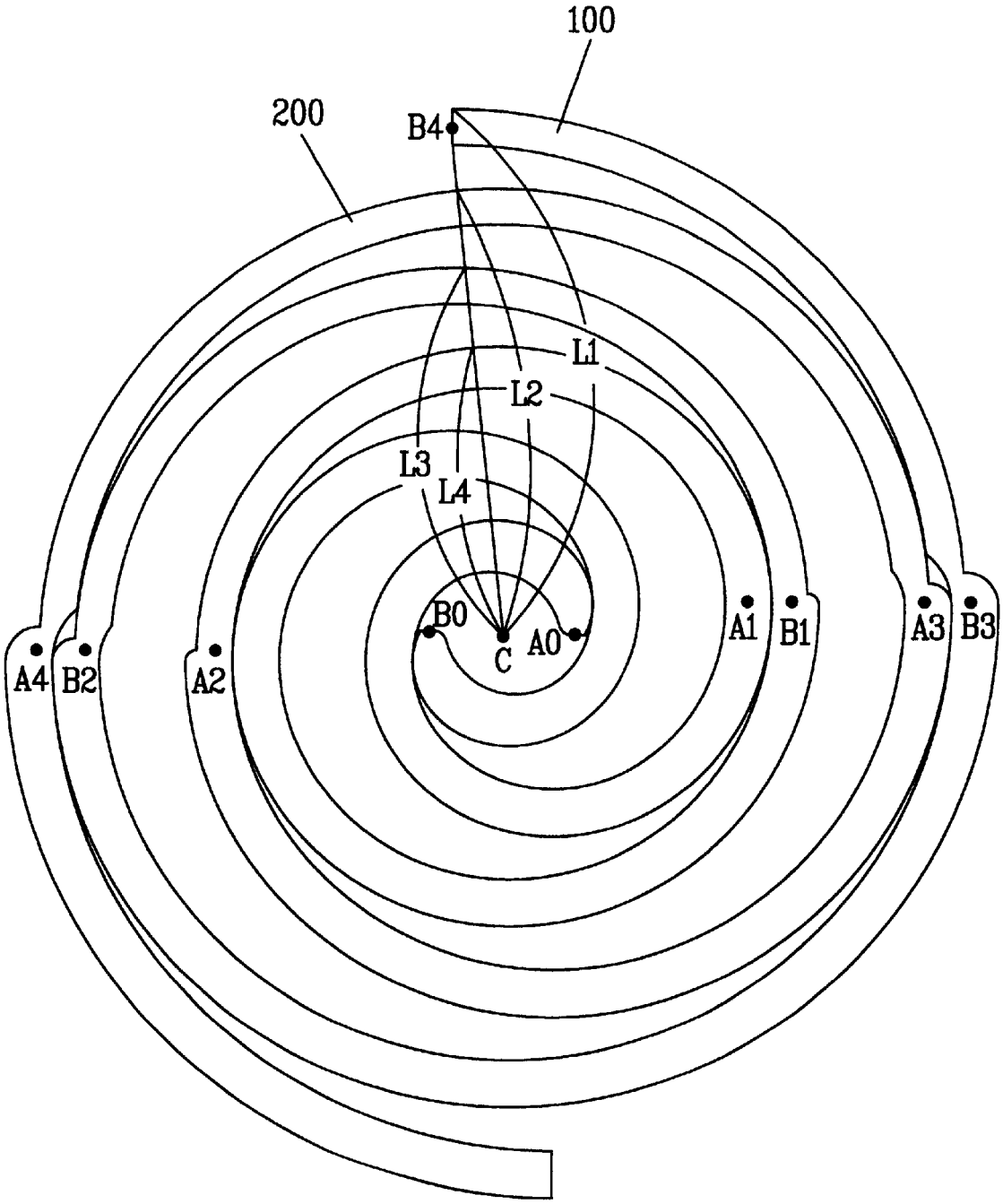
FIGS. 8A and 8B compare radiuses of the first embodiment scroll wraps of the present invention and the related art scroll wraps.
Figure 8B:
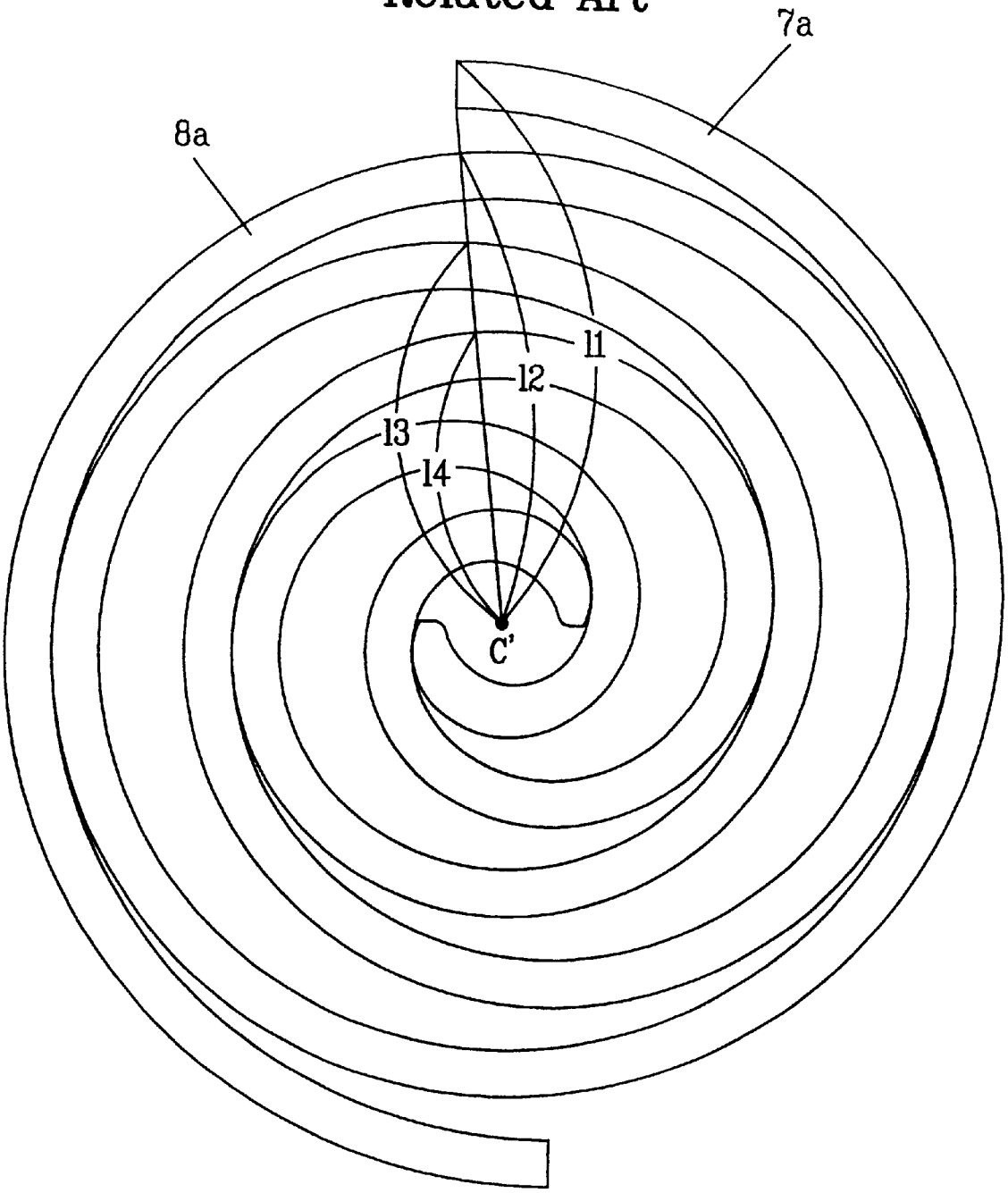
FIG.8B Related Art

FIGS. 8A and 8B compare radiuses of the first embodiment scroll wraps of the present invention and the related art scroll wraps.

Referring to FIGS. 8A and 8B, when it is assumed that a distance from an outer surface of an outer end of the orbiting scroll wrap 100 formed according to the second involute curve 102 to a center 'c' of the compression chamber is L1 (see FIG. 8A), and a distance from an outer surface of an outer end of the related art orbiting scroll wrap 7*a* to a center 'c' of the compression chamber is l1 (see FIG. 8B), L1 is shorter than l1, because the involute curve of the orbiting scroll wrap 100 has a relatively smaller angle of the starting point and base circle radius than the involute curve of the related art orbiting scroll wrap 8*a* at parts of B3–B4, to form a thinner wrap thickness and smaller wrap radius than the related art orbiting scroll wrap 8*a*.

Alike the L1, distances L4, L3, and L2 (see FIG. 8A) from the center 'c' to an outer surface of each of the parts A1-A2, B1-B2, and A3-A4 located in succession toward an outer end of each of the wraps 100 and 200 are shorter than l4, l3, and l2 (see FIG. 8B) in the orbiting scroll wrap 7*a* and the fixed scroll wrap 8*a* corresponding to the L4, L3, and L2 respectively.

As explained, since the lengths L1, L2, L3 and L4 of the wraps 100 and 200 are relatively shorter than l1, l2, l3, and l4, shifting locations of the parts of the wraps 100 and 200 inward, an outside diameter of the scrolls can be made smaller. Accordingly, a center of gravity of the orbiting scroll is shifted inward compared to the related art orbiting scroll, that improves stability of the orbiting scroll.

The scroll compressor having the first embodiment scroll wraps of the present invention applied thereto has the following advantages.

The formation of the scroll wrap from involute curves of different base circles and starting points in the first embodiment of the present invention varies radius of curvatures and thickness from part to part. That is, since parts of the wrap are shifted inward in a radial direction, together with a center of gravity of the scroll, stability of the scroll is enhanced.

The formation of parts of the scroll wrap from different involute curves, i.e., the first and second involute curves in the first embodiment of the present invention provides wrap thicknesss different from each other, with a wrap thickness from the second involute curve thinner than the warp thickness from the first involute curve, that increases a volume of the compression chamber as much as a reduction of the wrap thickness, to increase a compression space for the same size of scroll compressors. On the other hand, a central region of the scroll warp where a high pressure is occurred has the wrap thickness the same with the related art wrap, for not deteriorating reliability of the scroll compressor.

Second Embodiment

Figure 9A:
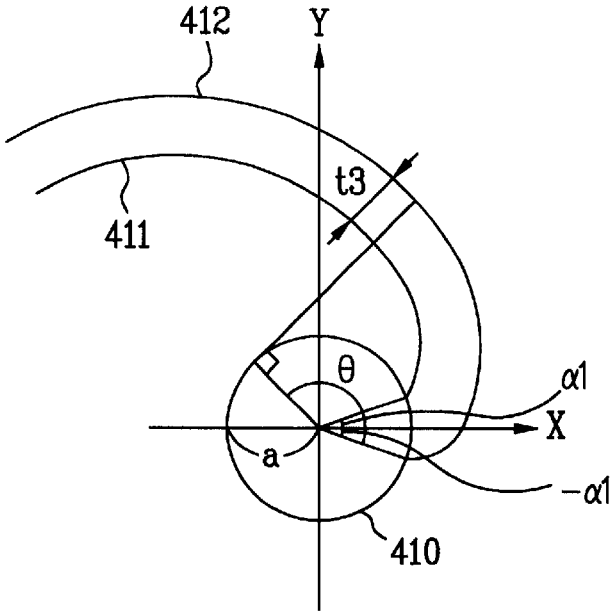
FIGS. 9A and 9B illustrate the steps of process for forming an orbiting scroll wrap and a fixed scroll wrap in accordance with a second preferred embodiment of the present invention.
Figure 9B:
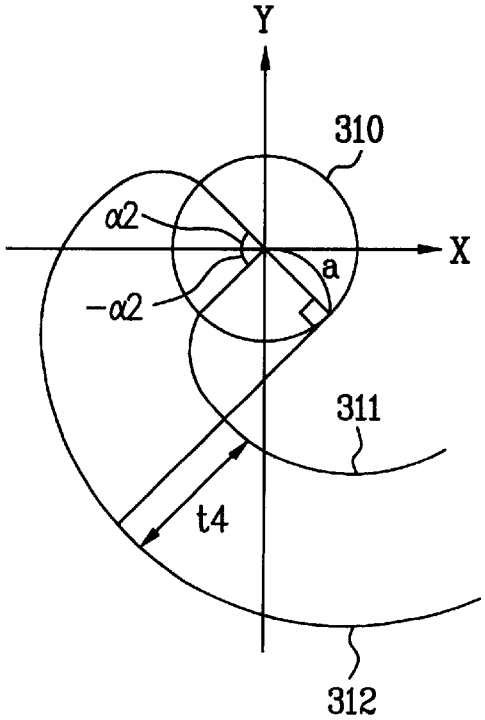
Figure 10:
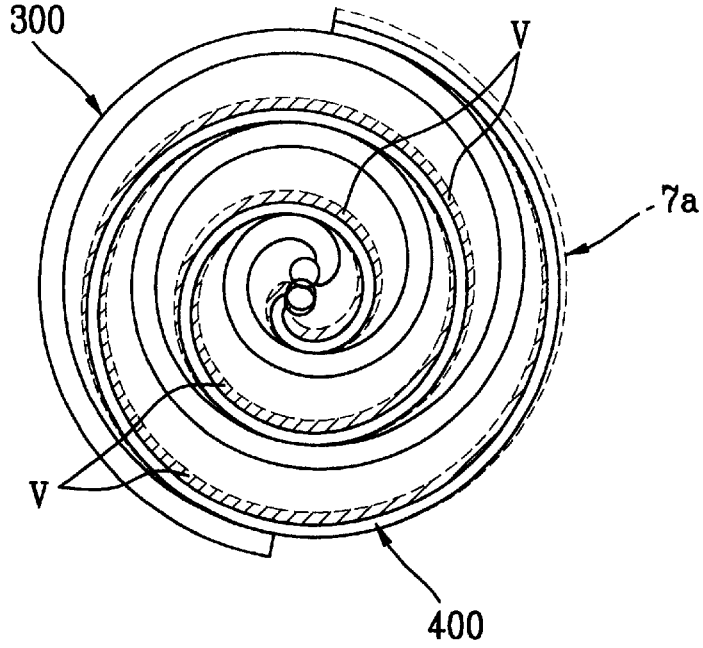
FIG. 10 illustrates a coupled state of an orbiting scroll wrap and a fixed scroll wrap formed in accordance with a second preferred embodiment of the present invention.

FIGS. 9A and 9B illustrate the steps of process for forming an orbiting scroll wrap and fixed scroll wrap in accordance with a second preferred embodiment of the present invention, and FIG. 10 illustrates a coupled state of an orbiting scroll wrap and a fixed scroll wrap formed in accordance with a second preferred embodiment of the present invention, referring to which structures of an orbiting scroll wrap 400 and a fixed scroll wrap 300 of the second embodiment of the present invention will be explained in detail.

Referring to FIG. 9A, for forming an orbiting scroll wrap 400, an imaginary base circle 410 with a radius 'a' is formed on a center on an X-axis and Y-axis. Then, an inner involute curve 411 is formed starting from a point on a circumference of the base circle 410 at an angle al from the X-axis. As shown in FIG. 9A, to form a thickness of the orbiting scroll wrap 400, an outer involute curve 412 is formed starting from a point on a circumference of the base circle 410 at an angle $-\alpha 1$ from the X-axis. The inner involute curve 411 and the outer involute curve 412 form an orbiting scroll wrap 400 having a thickness t3.

On the other hand, for forming the fixed scroll wrap 300, as shown in FIG. 9B, a base circle 310 is formed in a method the same with a case of the orbiting scroll wrap 400. Then, an inner involute curve 311 and an outer involute curve 312 are formed starting from points on a circumference of the base circle 310 at angles '$\alpha$' and '$-\alpha$' from the X-axis, respectively. The inner involute curve 311 and the outer involute curve 312 form a fixed scroll wrap 300 having a thickness 't4'. Both the orbiting scroll wrap 400 and the fixed scroll wrap 300 are formed from identical base circle, but with different starting points on a circumference of the base circle. The involute curves 411 and 412 of the orbiting scroll wrap 400 start at a point on the circumference of the base circle at an angle $\alpha 1$ to the X-axis, which is smaller than $\alpha 2$ to the X-axis both the involute curves 311 and 312 of the fixed scroll wrap 300 start therefrom.

That is, as shown in FIG. 10, by taking $\alpha 1$ to be one half of $\alpha 2$, the orbiting scroll wrap 400 having a thickness one half of the related art orbiting scroll wrap 7*a* can be obtained, with an increased volume of the compression chamber formed by the orbiting scroll wrap 400 and the fixed scroll wrap 300 as much as an amount of reduction of the thickness of the orbiting scroll wrap 400 (a part "V" hatched in FIG. 10), and a decreased mass of the orbiting wrap 400 as much as the decreased volume of the orbiting wrap 400.

As explained, the smaller the $\alpha 1$ of the orbiting scroll wrap, the larger the volume of the compression chamber, and the orbiting scroll wrap 400 is permitted to be engaged with the fixed scroll wrap 300 in a changed orbiting radius to make compression of the refrigerant.

On the other hand, it is preferable that the $\alpha 1$ is restricted to be $0.5\alpha 2 \leqq \alpha 1 < \alpha 2$ because excessive reduction of the wrap thickness causes strength and pressure problems of the orbiting wrap 400 and the fixed scroll wrap 300.

The scroll compressor having the second embodiment scroll wrap of the present invention applied thereto has the following advantages.

The formation of the thickness of the orbiting scroll wrap relatively thinner than the related art orbiting scroll wrap increases the volume of the compression chamber formed by the orbiting scroll wrap and the fixed scroll wrap as much as the reduction of thickness of the orbiting scroll wrap thickness, permitting to secure more compression space even though neither a frame size of the scroll compressor, nor a height of the wrap, is increased. Moreover, as weight of the scroll becomes the lighter as much as the thickness of the wrap is made the thinner, the orbiting scroll wrap can be made the lighter that allows improving stability of the orbiting scroll.

Third Embodiment

Figure 11A:
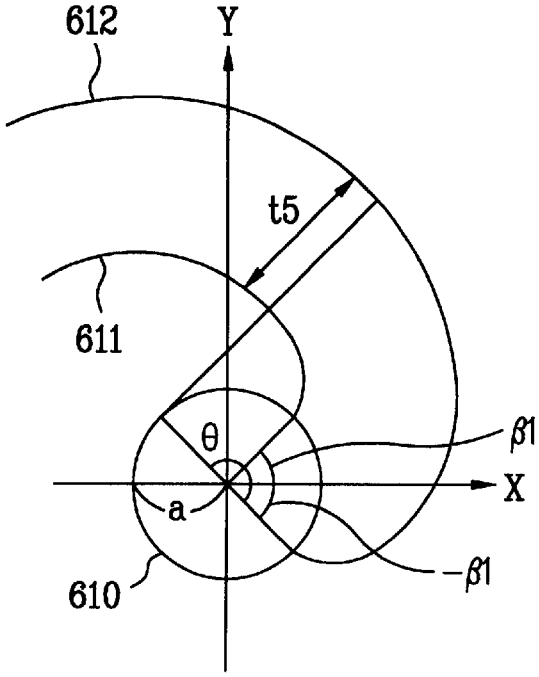
FIGS. 11A and 11B illustrate the steps of process for forming an orbiting scroll wrap and a fixed scroll wrap in accordance with a third preferred embodiment of the present invention.
Figure 11B:
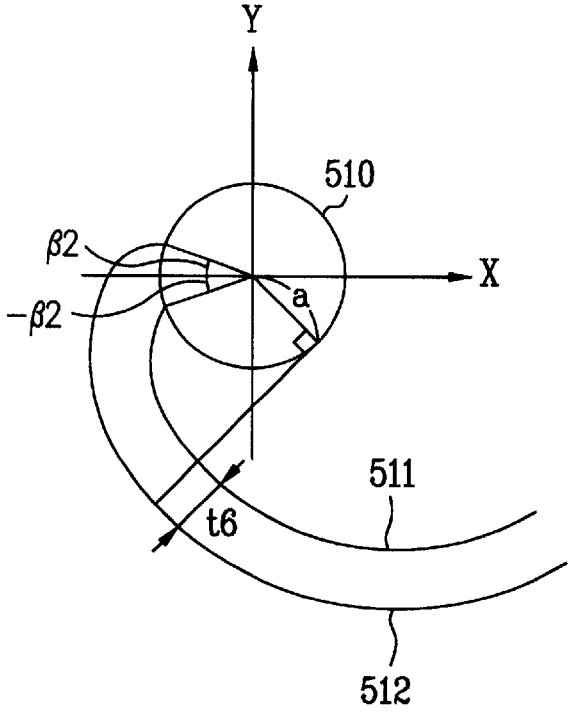
Figure 12:
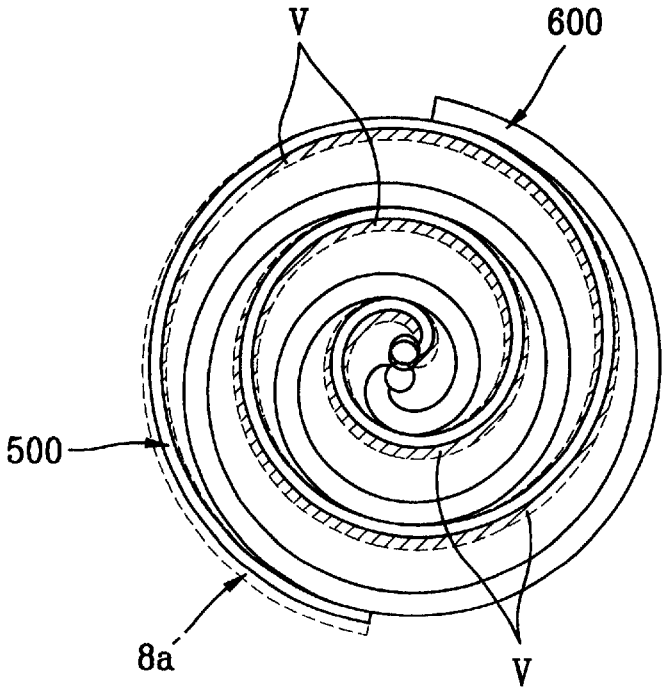
FIG. 12 illustrates a coupled state of an orbiting scroll wrap and a fixed scroll wrap formed in accordance with a third preferred embodiment of the present invention.

FIGS. 11A and 11B illustrate the steps of process for forming an orbiting scroll wrap and a fixed scroll wrap in accordance with a third preferred embodiment of the present invention, and FIG. 12 illustrates a coupled state of an orbiting scroll wrap and a fixed scroll wrap formed in accordance with a third preferred embodiment of the present invention, referring to which structures of an orbiting scroll wrap 600 and a fixed scroll wrap 500 of a scroll compressor in accordance with the third preferred embodiment of the present invention will be explained.

Alike the description in association with FIGS. 9A 9B, for forming an orbiting scroll wrap 600, an inner involute curve 611 is formed starting from a point on a circumference of a base circle 610 with a radius 'a', i.e., at an angle $\beta 1$ from an X-axis. To form a thickness of the orbiting scroll wrap 600, an outer involute curve 612 is formed starting from a point on a circumference of the base circle 610 at an angle $-\beta 1$ from the X-axis. The inner involute curve 611 and the outer involute curve 612 form an orbiting scroll wrap 600 having a thickness t5.

On the other hand, for forming the fixed scroll wrap 500, a base circle 510 with a radius 'a' is formed in a method the same with a case of the orbiting scroll wrap 600. Then, an inner involute curve 511 and an outer involute curve 512 are formed starting from points on a circumference of the base circle 510 at angles '$\beta$' and '$-\beta$' from the X-axis, respectively. Thus, the inner involute curve 511 and the outer involute curve 512 form a fixed scroll wrap 500 having a thickness 't6', of which detailed description will be omitted as the third embodiment scroll wraps can be understandable from the prior embodiments. Both the orbiting scroll wrap 600 and the fixed scroll wrap 500 are formed from identical base circle with a radius 'a', but with different starting points on a circumference of the base circle. The involute curves 511 and 512 of the fixed scroll wrap 500 start at a point on the circumference of the base circle at an angle $\beta 2$ to the X-axis, which is smaller than $\beta 1$ to the X-axis both the involute curves 611 and 612 of the orbiting scroll wrap 600 start therefrom.

That is, as shown in FIG. 12, by taking $\beta 2$ to be one half of $\beta$, the fixed scroll wrap 500 having a thickness reduced as much as "V" compared to the related art fixed scroll wrap 8*a* can be obtained.

It is preferable that the $\beta 2$ is taken to be within a range of $0.5\beta 1 \leqq \beta 2 < \beta 1$, for increasing the compression space, of which detailed explanation will be omitted, as it is understandable from the foregoing explanation.

The scroll compressor having the third embodiment scroll wraps of the present invention applied thereto has advantages the same with the second embodiment of the present invention.

It will be apparent to those skilled in the art that various modifications and variations can be made in the scroll compressor of the present invention without departing from the spirit or scope of the invention. Thus, it is intended that the present invention cover the modifications and variations of this invention provided they come within the scope of the appended claims and their equivalents.

What is claimed is:

1. A scroll compressor comprising:

an orbiting scroll having an orbiting wrap formed from a first orbiting involute curve and a second orbiting involute curve, wherein said first and second orbiting involute curves each have a base circle and a starting point different from each other;

a fixed scroll having a fixed wrap formed from a first fixed involute curve and a second fixed involute curve, wherein said first and second fixed involute curves each have a base circle and a starting point different from each other; said wraps being engaged with each other on opposite surfaces of the orbiting scroll and the fixed scroll; and a compression chamber formed as the orbiting scroll orbits with respect to the fixed scroll, wherein the first and second fixed involute curves and the first and second orbiting involute curves have starting points different from each other and employed alternately.

2. A scroll compressor as claimed in claim 1, wherein the second involute curve has the base circle radius and an angle to an X-axis of the starting point smaller than the first involute curve.

3. A scroll compressor as claimed in claim 1, wherein the orbiting scroll wrap employs the second orbiting involute curve from 450° of involute angle and over, and the fixed scroll wrap employs the second fixed involute curve from 630° of involute angle and over.

4. A scroll compressor as claimed in claim 1, wherein the first involute curve and the second involute curve are used alternately at 180° intervals of the involute angles of respective involute curves.

5. A scroll compressor as claimed in claim 4, wherein the first and second involute curves begin alternating at 90° of involute angle from an outer end of the orbiting scroll wrap or the fixed scroll wrap.

* * * * *